United States Patent [19]

Gilvar

[11] 3,940,961

[45] Mar. 2, 1976

[54] APPARATUS FOR COOLING HOT ROLLED STEEL ROD BY FORCED AIR CONVECTION OR BY SUPPLYING HEAT

[75] Inventor: Martin Gilvar, Oakham, Mass.

[73] Assignee: Morgan Construction Company, Worcester, Mass.

[22] Filed: Nov. 18, 1974

[21] Appl. No.: 524,458

[52] U.S. Cl. ..... 72/40; 72/201; 140/2; 266/3 R

[51] Int. Cl.²B21B 45/02; B21B 45/04; B21C 43/00; B21F 21/00

[58] Field of Search..... 29/81 C, 81 F, 81 K; 72/39, 40, 200, 201, 202; 140/2; 148/12 B, 134, 143, 153; 432/2, 78; 266/2 R, 2 A, 2.5, 3 R

[56] References Cited

UNITED STATES PATENTS

| | | | |
|---|---|---|---|
| 777,178 | 12/1904 | Boley | 29/81 K |
| 3,231,432 | 1/1966 | McLean et al. | 148/12 B |
| 3,390,871 | 7/1968 | McLean et al. | 266/3 R |
| 3,452,785 | 7/1969 | McLean et al. | 140/2 |
| 3,718,024 | 2/1973 | Vitelli | 72/201 |
| 3,720,544 | 3/1973 | Entringer | 148/134 |
| 3,865,153 | 2/1975 | Vitelli | 140/2 |

FOREIGN PATENTS OR APPLICATIONS

| | | | |
|---|---|---|---|
| 641,162 | 5/1962 | Canada | 72/40 |

*Primary Examiner*—Milton S. Mehr
*Assistant Examiner*—E. M. Combs

[57] ABSTRACT

Apparatus is provided for uniformly cooling hot rolled rod over a continuous range of cooling rates from less than 0.5° C/sec. to about 20° C/sec. together with a mechanism for removing scale accumulated therein in a confined and safe manner. The context is that of cooling hot rolled steel rod directly after the steel leaves the rod mill wherein the rod may either be cooled rapidly by forced air convection or cooled very slowly under conditions in which a heated fluid or radiant heating must actually be employed in order to retard the cooling rate. The apparatus includes a group of cooling chambers, each of which has a blower which can be used to force cool air from the atmosphere onto the rod. Some of the cooling chambers are also equipped with means for supplying heat to the rod as may be necessary to retard the cooling rate. When this is done in air, scale formation on the steel is more extensive due to the prolongation of time at high temperature, and as the scale builds up, it also tends to break away from the rod and fall to the bottom of the cooling chamber. The air streams, which are otherwise used to control the cooling of the steel by forced air convection, can then be redirected and used to entrain and dispose of the scale from the cooling chambers. This is done by an arrangement of ducts and dampers whereby the blowing is adapted to draw air either from the atmosphere for cooling or from the cooling chamber where the scale accumulates, for scale disposal. Thus, when the apparatus has been used in the retarded cooling mode, and it becomes desirable to change to the rapid cooling mode, the dampers are set so that the blowers withdraw scale from the cooling chambers and transmit it to the scale disposal facility. Then the dampers are reset so that the blowers can transmit air into the cooling chambers to cool by forced air convection. When the means for supplying heat to some other cooling chambers are used, in order to retard the cooling rate, the remaining cooling chambers may be used to cool either by natural or forced convection. Those chambers being used for cooling by natural convection may be alternately adapted for the removal of scale accumulation by the use of a blower. The cooling chambers are equipped with an arrangement of nozzles adapted to apply a greater proportion of the cooling medium to the sides of the rings than to the centers. This helps to overcome the mass-effect of the overlapped rings at the side of the conveyor so as to cool more uniformly in the rapid cooling mode. The same nozzles may also be employed in the slow cooling mode when a heated gas is applied to the rod.

6 Claims, 6 Drawing Figures

APPARATUS FOR COOLING HOT ROLLED STEEL ROD BY FORCED AIR CONVECTION OR BY SUPPLYING HEAT

BACKGROUND OF THE INVENTION

The present invention relates to an apparatus for cooling hot rolled steel rod in direct sequence with a rod mill and, more particularly, to an apparatus which cools steel either by forced convection or by actually supplying heat to produce a retarded cooling rate during transformation of the steel. Cooling while supplying heat is defined as exposing the steel to radiant heat or to a fluid medium which is substantially above room temperature. The medium can even be at the same temperature as the rod, or slightly higher to offset the loss of heat of the rod by radiation.

A process is known from U.S. Pat. No. 3,231,432 which cools hot rolled steel rod by forced air convection as the rod leaves the last stand of a rod mill. In the cited process, the rod is first formed into flat overlapping non-concentric rings. The rings are then conveyed into a cooling chamber. In the cooling chamber forced air contacts the rings and uniformly cools them. The cited process imparts good properties of tensile strength and ductility to most medium to high plain carbon steels. For a majority of finished products, such rod need not be heat treated subsequently. Additionally, in the cited process, scale loss is minimized.

However, when low carbon steels and certain steel alloys are cooled by the cited process, in some cases they may have inadequate ductility. This results from the fact that the cooling rate during transformation of the steel is too high. In fact, it is often difficult to keep the cooling rate low enough for such steels because the loss of heat by radiation is a major factor in the 500°C to 700°C (transformation) range. Although cooling in the open by natural convention alone is slower than forced (cold) air convection, it is much too fast for the necessary slow cooling for certain steels. Even an insulated box can absorb the radiated heat at a faster rate than may be tolerated by some steels. Accordingly, it is necessary in such cases to apply radiant heat or a heating cooling medium to the rod and to the chamber surrounding the rod so as to reduce the radiation heat loss rate.

During retarded cooling in air, however, the formation of scale is increased and thereafter, when the apparatus is again used for accelerated cooling, the residue of scale which cracks off and falls into the cooling chamber becomes a serious problem. If this accumulated scale is not removed, it will subsequently be blown into the atmosphere by the cooling blowers after a shift to normal high speed cooling, and scale blown around a mill may be a hazard to personnel as well as cause damage to equipment through contamination of lubricants.

There are several previously known methods for the general prevention or removal of scale. For instance, the use of a non-oxidizing or reducing atmosphere to prevent scale formation has been employed in furnaces. Using a reducing atmosphere, however, becomes complicated and difficult when the apparatus or a part of it is to be used for cooling by forced convection. In addition, after scale has already formed on the steel, there are conventional ways to remove it either by chemical or mechanical action. However, none of such conventional approaches deals with the problem of removing an accumulation of scale in apparatus which is adapted both for rapid cooling by forced air convection and for slow cooling under conditions where heat is added. The provision of equipment for so doing is one of the objectives of this invention.

SUMMARY OF THE INVENTION

According to the present invention, there is provided an apparatus for cooling hot rolled steel rod by either forced air convection or by retarded cooling in which heat is actually supplied, wherein the scale which accumulates in the apparatus during the retarded cooling mode may be removed from the apparatus and transmitted to a collection facility. More particularly, the apparatus includes a group of cooling chambers equipped with means for receiving, conveying and cooling the steel. Blowers are provided to supply cooling air to one or more of the chambers. Also, one or more of the chambers may be provided with means for adding heat so as to retard the cooling rate of the steel passing therethrough. Control devices are provided to regulate the action of the blowers so as to cool by forced air convection or, alternatively, to withdraw scale from the apparatus and transmit it to a collection facility. One advantage of the invention is that scale accumulation formed during operation of the slow cooling mode may be removed in a safe manner prior to operation of the rapid cooling mode. Thus, the atmosphere of the steel mill need not be contaminated, and safety hazards from particles entrained in the atmosphere are reduced. Furthermore, the collecting of scale in a designated facility makes it possible to recover the economic value of the scale itself. As an additional advantage, the same blowers employed for forced air convection are also employed for removing the scale accumulation.

In a preferred form of the invention, each of the cooling chambers includes a series of rollers arranged and driven so as to convey the steel through the chamber, and dividing the chamber into an upper portion housing the rod rings and a lower portion defining a plenum. When heat is supplied for retarded cooling, scale forms on the rod rings, breaks off, and falls between the rollers into the lower plenum. Dampers are employed both upstream and downstream of the blower alternatively to blow cooling air into the plenum, or to draw air (and scale) from the plenum and direct it to a scale collection facility.

Another feature of the present invention resides in an arrangement of nozzles which is compatible with very slow cooling but which also provides for uniformly cooling the steel by forced air convection. The steel is conveyed through the cooling chamber in the form of overlapping, non-concentric rings in such a manner that more metal is concentrated at the sides. The chamber is provided with apron plates between the conveyor rollers and the nozzles are formed in the plates. The forced air (hot or cold) is projected onto the rings through the nozzles, which are dimensioned and arranged so that a greater quantity of cooling medium is applied to sides of the rings.

DESCRIPTION OF PREFERRED EMBODIMENTS

Figure 1:
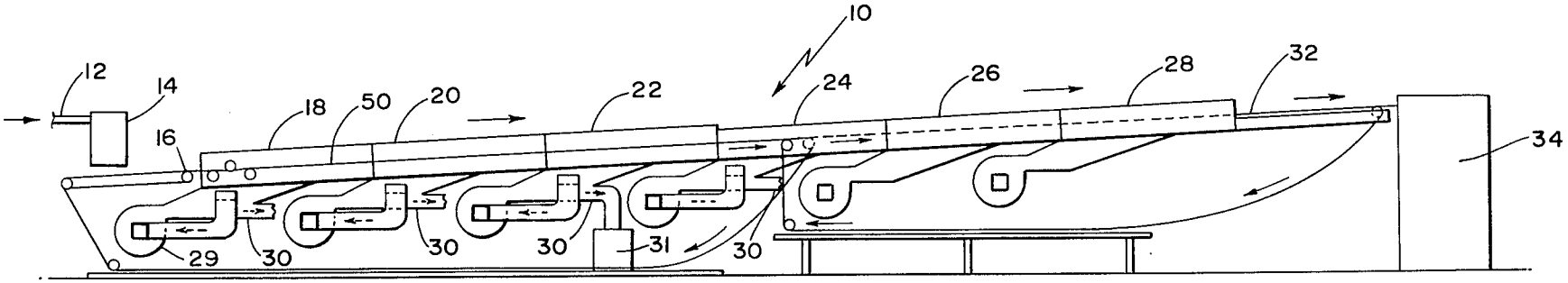
FIG. 1 is a diagrammatic illustration of a side view of an embodiment of the apparatus for cooling hot rolled steel rod according to this invention, depicting a plurality of cooling chambers.
Figure 4:
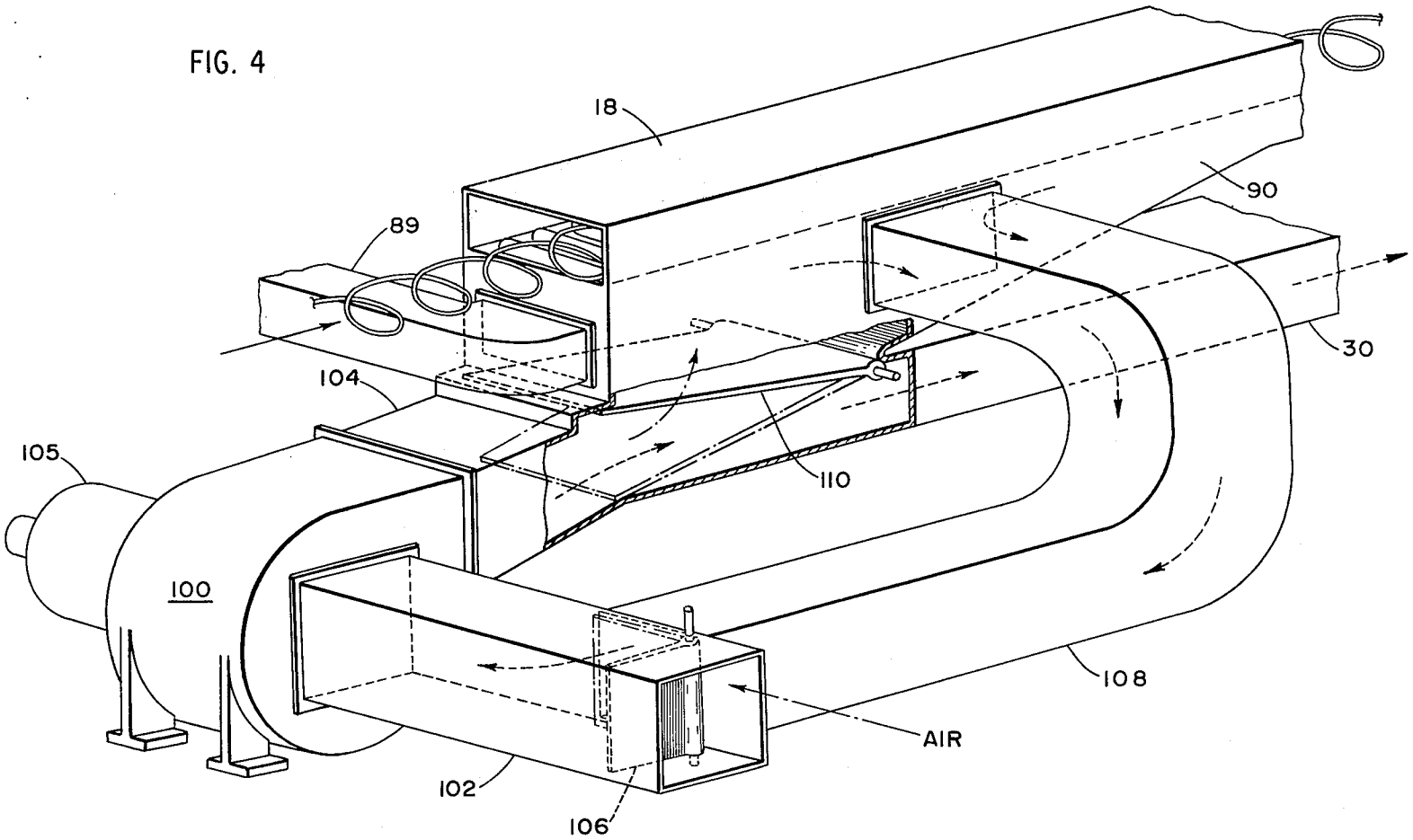
FIG. 4 is a perspective view of a cooling chamber and scale removal apparatus according to the present invention.

In an exemplary embodiment of the present invention, FIG. 1 depicts a continuous, cooling apparatus, represented generally by the reference numeral 10, for cooling hot rolled steel rod in direct sequence with a rod mill. The rolled rod issuing from the rod mill at a temperature of about 950°C to 1050°C is directed through a cooling and guide pipe 12 to a laying reel or cone, represented at 14. Water is introduced into the cooling pipe 12 to preliminarily cool the rod. The exact temperature to which the preliminary cooling is carried, depends on the end product requirements but is usually greater than 676°C. Laying cone 14 deposits the rod rings onto a moving conveyor 16 in the form of flat overlapping non-concentric rings (as shown in FIG. 4). U.S. Pat. No. 3,231,432 describes one of several devices which may be used for the laying cone 14.

The rod is then conveyed into a plurality of cooling chambers 18, 20, 22, 24, 26 and 28 where the rod is cooled at a controlled rate to impart the desired tensile strength and ductility to the rod. In the preferred embodiment of FIG. 1, each of the cooling chambers has a blower assembly 29 for cooling the rod by relatively cold forced air convection. The use of relatively cold forced air convection comprises the rapid cooling mode of operation of the apparatus, and this mode is used primarily for cooling medium to high carbon steel. In the slow cooling operational mode, which is primarily for low carbon steels and certain steel alloys, various ways are available. For example, chambers 18, 20, 22, and 24 may be used for natural air convection alone, with chambers 26 and 28 completing the cooling by forced air convection. In another arrangement, the blower assemblies 29 of the chambers 18, 20, 22 and 24 may be disengaged, and instead heat may be actually supplied to the chambers 18, 20 and 22 by introducing hot gas or otherwise to retard the cooling rate of the steel. Additionally, in accordance with the present invention, the blower assemblies of the cooling chambers may be employed to remove scale assumulation following operation in the slow cooling mode.

The scale is withdrawn from the chambers and is transmitted to a scale collection facility, represented generally at 31. The details of the arrangement of ducts associated with each blower assembly and of the control devices within these ducts which together permit the blower assembly to remove the scale are shown in FIG. 4. While in FIG. 1, the scale collection facility is shown being connected only to the chamber 22, it is to be understood that each of the chambers 18, 20, 22, 24, 26 and 28 may be connected to a common scale collection facility which may be remote from the cooling apparatus. The scale collection facility may have a gas cleaning device. While the details of such a device are not shown, those skilled in the art are familiar with various electrostatic precipitators, bag filters, vortical or centrifugal separators (wet or dry) and various combinations thereof which may be suitable.

At the entrance of chamber 24, the conveyor 16 terminates, and transfers the rod to a conveyor 32 which carries the rod through the remaining chambers to a ring collecting device 34. The details of the collecting device are not shown but there are several known suitable devices, including that described in U.S. Pat. No. 3,231,432. Drive chains for the conveyors 16 and 32 extend into mutually overlapping relationship.

In the present invention, a single apparatus is employed to cool different types of steel at their respective optimum cooling rates. Most medium to high carbon steels are uniformly cooled fairly rapidly (7°C/sec. up to about 20°C/sec.) by forced air convection throughout the length of the apparatus. At such cooling rates the steel is given optimum tensile strength and ductility properties. However, if low carbon steels and certain steel alloys are cooled at rates as high as that, the tensile strength may be too high and/or the ductility too low. By retarding the cooling rate, as for instance in chambers 18, 20 and 22 by supplying heated gas thereto, the cooling rate through transformation of the steel can be decreased, to the range of 0.3°C/sec. to 6°C/sec. so as to arrive at an appropriate tensile strength and/or ductility. Preferably such steels are thereafter cooled at a higher rate by forced or natural air convection in chamber 24 and by rapid forced air convection in chambers 26 and 28 to reduce the temperature sufficiently for convenient handling.

In a suitable installation, the operating characteristics may be as follows. Each of the six chambers is 30 feet long and, therefore, the entire apparatus is 180 feet long. For cooling low carbon steels and certain steel alloys, the cooling rate is 0.3°C/sec. to 6°C/sec in the chambers 18, 20 and 22, 7°C to 10°C/sec. in the chamber 24, and 7°C to 20°C/sec. in the chambers 26 and 28.

Several variables control the cooling rate of the particular steel; these include the rate at which the rod is fed to the conveyor, the temperature at which the rod is fed to the conveyor, the conveyor speed, the stacking thickness of the rings and the temperature of the cooling zones. These variables may be appropriately controlled to produce the desired cooling rate.

Figure 2:
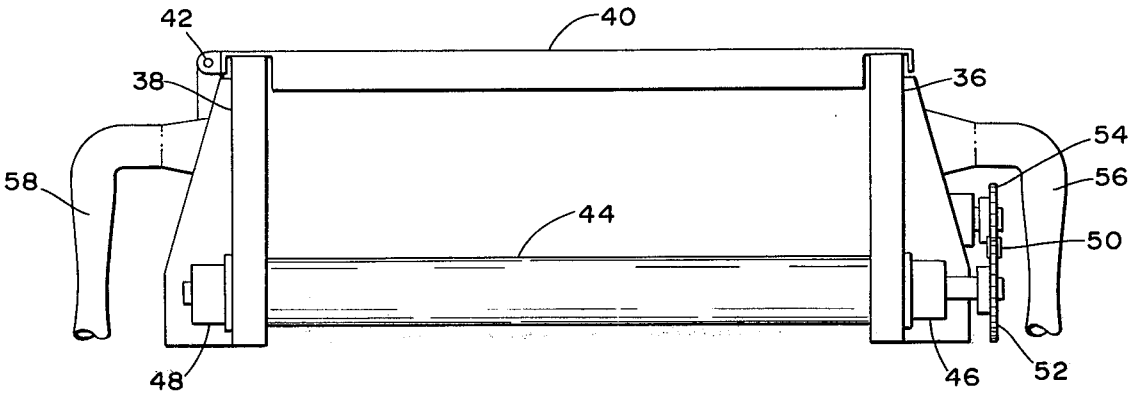
FIG. 2 is a front elevation view of a single cooling chamber employed in the apparatus of FIG. 1.

Referring now to FIG. 2, there are depicted details of the chambers 18, 20 and 22 employed in cooling the rod either by supplying heated gas or by cool forced air. Each of these chambers has a pair of heat insulated side walls 36 and 38 and a heat insulated top plate 40. The top plate 40 is pivotally hinged at 42 so that the top plate may be opened or closed. When these chambers are employed to cool by either natural or forced air convection, the top may be left open to enhance the air convection; the tops of the chambers 24, 26 and 28 shown in FIG. 1 are usually left open permanently because these chambers normally are used only for rapid cooling. When the chambers 18, 20 and 22 are used in the slow cooling mode, the top of the chamber is closed so as to contain the heat within the chamber. Any suitable power drive system, or an overhead crane, may be used for placing or removing the top plate 40.

A series of rotating rollers carry the rod rings through the chambers 18, 20 and 22. Each of the rollers, shown at 44, is mounted on the side walls 36 and 38 to rotate in bearing assemblies 46 and 48, respectively. All of the rollers 44 within the chambers 18, 20 and 22 are driven by a drive chain 50. This drive chain 50 is driven by a suitable drive motor (not shown). The drive chain 50 passes over a series of drive sprockets 52 and idler sprockets 54. The bearing assemblies 46 and 48 are preferably water cooled to remove heat which may be conducted to them from the rollers 44. Each sprocket wheel 52 is mounted on the end of the center shaft of each roller 44. The drive chain 50 is placed outside of the chambers 18, 20 and 22 in order to minimize the loss of lubrication which would otherwise occur if the chain were inside the chamber during the heating phase of the slow cooling mode. However, the conveyor 32 and its sprockets and chains may normally be disposed within chambers 24, 26 and 28 as in the manner shown in U.S. Pat. No. 3,231,432 because those chambers are not normally heated.

Figure 3:
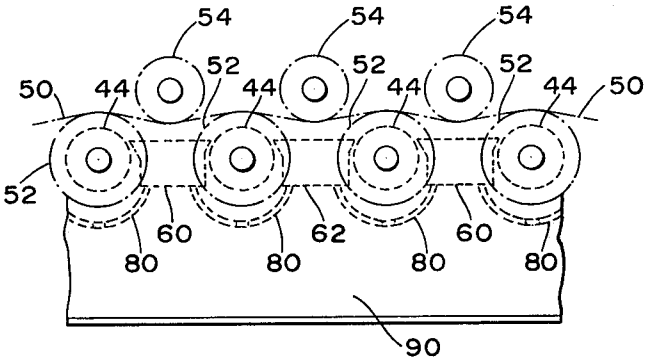
FIG. 3 is a diagrammatic view in side elevation of a conveyor for moving the steel in the cooling chamber of FIG. 2.

The preferred technique for retarded cooling, wherein heat is supplied, is performed by introducing heated gas from a suitable heat source, such as a gas burner (not shown), through a duct 89 into a plenum chamber indicated at 90 in FIGS. 3 and 4.

The copending application of Norman A. Wilson, Ser. No. 516,767, filed Oct. 21, 1974, discloses a type of gas burner arrangement which might be used to introduce the heated gas into the present apparatus.

Figure 5:
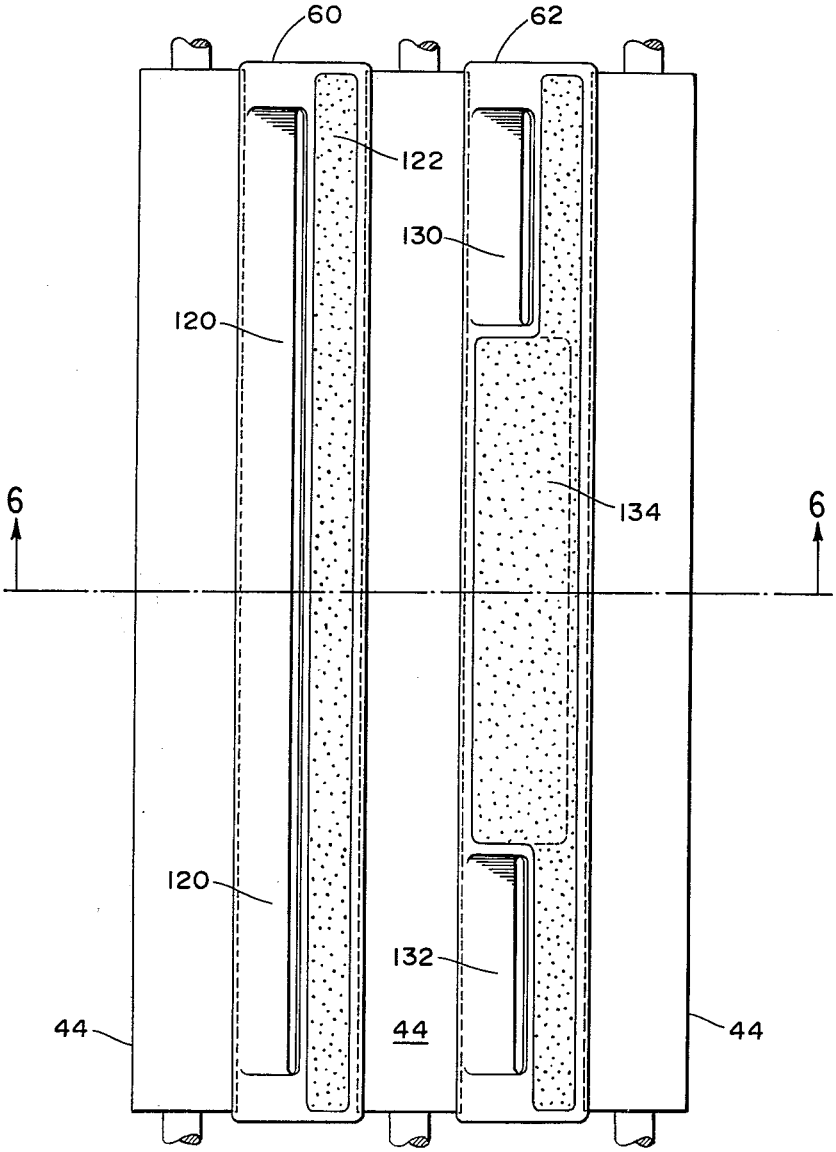
FIG. 5 is a plan view of the interior of the cooling chamber showing the conveyor rollers, apron plates and nozzles therein for uniformly cooling the steel during the forced air convection and retarded cooling modes.

The heated gas passes through the plenum 90 and upwardly through nozzles 120, 130 and 132 shown in FIG. 5. Several means may be used for supplying the heat needed to retard the cooling rate of steel. FIG. 2 shows an alternative method wherein hot gases, supplied from a suitable source of hot gases, such as a gas burner (not shown), are introduced into the upper part of the cooling chamber through conduits 56 and 58 which are mounted on the side walls 36 and 38, respectively.

Hot gases are initially introduced at high volume, to bring chambers 18, 20 and 22 up to suitable temperature. As processing continues, heat contributed by the material itself allows the hot gases to be throttled back so as to achieve a heat balance at the proper chamber temperature.

Referring now to FIG. 3, there is shown a detailed diagram of a portion of the conveyor 16 for the chambers 18, 20 and 22. A series of apron plates 60 and 62 are disposed respectively between the rollers 44. The idler sprockets 54 maintain the drive chain 50 in contact with the drive sprockets 52, thereby ensuring that the rollers 44 uniformly rotate and move the rod rings through the chambers 18, 20 and 22. The apron plates, described in more detail subsequently, prevent the rod from getting caught between the rollers and serve as the means for distributing the air or hot gas which is applied to the rod when the chambers employed to cool by forced air convection or by retarded cooling, respectively. A series of semi-circular plates 80 extend below each roller 44; these plates 80 collect the scale which falls between the rollers 44 and the plates 60 and 62. Each plate 80 has a bottom opening to permit the scale to fall into the plenum 90.

Turning now to the problem of removing the scale which settles in the plenum 90, scale is, of course, the oxidized surface of steel which forms when the steel is at elevated temperatures. The oxides which form normally include FeO, $Fe_2O_3$, and $Fe_3O_4$. The amount of scale formation and the proportions of each ingredient depend upon the temperature, the time and the amount of oxygen available. While some scale may form on steel which is cooled rapidly after rolling by forced air convection, the amount is small and it does not present a significant hazard in the mill. However, the steels, which are cooled more slowly through transformation, have a correspondingly greater scale formation because they are maintained at a higher temperature for a longer time. As those steels pass over the rollers in the chambers 18, 20 and 22, some scale breaks off and accumulates within the chamber 24 when cooling in this chamber is by natural air convection. If such accumulated scale is not removed, it will be carried into the atmosphere when these chambers are thereafter used in the rapid cooling mode and air is blown through them.

Referring now to FIG. 4, there is shown in detail a blower assembly which may be employed both for removal of scale accumulation and for cooling rapidly by forced air convection. A blower 100 produces an air stream which flows from through a blower input duct 102 through the blower to a blower output duct 104. A drive means, such as a motor 105, operates the blower 100. An input damper 106 controls the input to the blower 100. When the damper 106 is normal to the axis of duct 102, the input to the blower comes from a duct 108 which leads from the plenum 90. When the input damper 106 moved to its other position at which it is parallel to duct 102 and normal to duct 108, the blower input is air from the atmosphere.

An output damper 110 controls the gas flow out of the blower 100. When the damper 110 is in the position shown in FIG. 4, the gas flows through a duct 30 which leads to the scale collection facility 31 (shown in FIG. 1). When the output damper 110 is positioned as shown in dotted lines, the blower output enters the plenum 90.

In operation, the blowers for the chambers 18, 20 and 22 are not turned on when low carbon steels or certain steel alloys are being cooled. At such a time, heat may be applied to the rod in those chambers so as to slow the cooling rate. Also, the blower for chamber 24 may be inoperative because chamber 24 is normally employed to cool the rod only by natural air convection. Thereafter, when shifting from the slow cooling mode to the rapid cooling mode, the dampers 106 and 110 are first placed in the positions shown in FIG. 4 and the blower is activated. In this position the scale which may have accumulated in the plenum 90 is withdrawn by the airstream through ducts 108, 102, 104 and 30, and is accumulated in the scale collection facility 31. The dotted arrows in FIG. 4 trace the motion of the scale. Thereafter, the dampers 106 and 108 are positioned as shown in dotted lines in FIG. 4 and the equipment is ready for processing steel by the rapid cooling mode wherein the blowers are activated and the dampers set so that air passes through the ducts 102 and 104, into the plenum 90 and through the nozzles 120, 130 and 132 to the rod.

Figure 6:
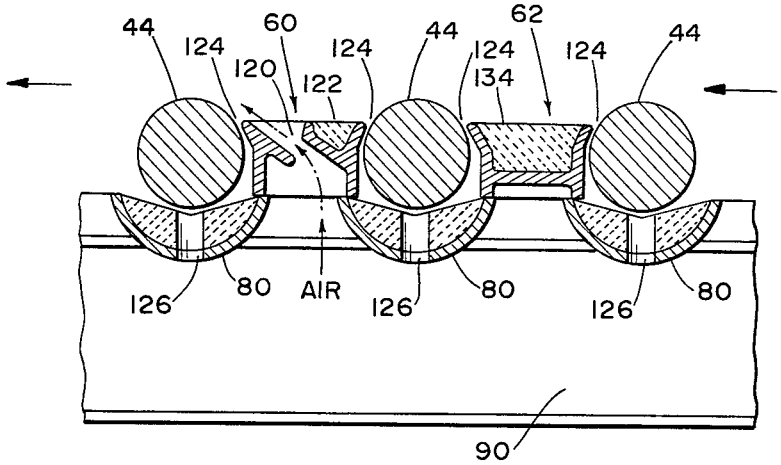
FIG. 6 is a sectional view of the inner portions of the cooling chamber taken along line 6—6 of FIG. 5.

FIGS. 5 and 6 show the arrangement of the rollers 44 and spacers 60 and 62 within each of the chambers 18, 20 and 22. The rollers 44 have apron plates 60 and 62 disposed therebetween. The apron plate 60 has a lengthwise open slot 120 which forms a nozzle through which air from the blower or heat from the plenum chamber 90 passes upwardly to cool the steel. A region 122 may be filled with a material such as a castable refractory. Between the rollers 44 and the apron plates 60 and 62 are openings 124 through which the scale falls. The scale then accumulates in the plenum 90 by passing through an opening 126 in the semi-circular plates 80. The apron plate 62 has a pair of end slots 130 and 132 which also form nozzles for injecting cool air or heated gas onto the rod rings. A region 134 is provided with a castable refractory surface material. Identical pairs of apron plates 60 and 62 are disposed between the remaining rollers 44 within each of the chambers 18, 20 and 22. Thus, over the length of these chambers there is a greater quantity of air or heat applied to the rod rings at the sides of the conveyor than at the center. The result of having greater cooling at the edges of the conveyor than at the center is that in the rapid cooling (forced air convection) mode, the steel is cooled more uniformly than would be the case if the cooling medium were applied to the rod evenly across the width of the zone. The non-uniform nozzle pattern compensates for the greater mass of steel present at the side edges of the zone than at the center due to the steel being forced into flat overlapping, non-concentric rings. During the slow cooling mode convection is much less important and the heat supplied primarily serves to prevent rapid heat loss by the rod by radiation. Thus, even though more gas may be applied to the sides of the conveyor the result is not to cause any major non-uniform cooling.

Among the advantages of the present invention is the fact that scale which accumulates during slow cooling may be removed and that the apparatus can be employed either for rapid cooling or slow cooling alternately without creating a hazard from scale being blasted into the mill atmosphere. Also, the scale may be collected and its economic value may be recaptured.

In its broadest aspect the apparatus of my invention relates to the removal of scale from any apparatus in which any metal is being continuously treated at oxide formation temperature. Thus in this aspect it is not limited to the treatment of steel rod rings. In any such treatment apparatus the scale which breaks off during treatment will accumulate at the bottom of the treatment chamber. My invention can be used in such treatment apparatus by the provision of blowers and ducts essentially as I show them arranged at the bottom of any treatment chamber to project a current of air through the area where the scale collects and force it into a disposal duct. In addition, such a treatment chamber and the ducts leading to it can be provided with controllable dampers so that the same blower can be used alternately for blowing cooling air onto the metal, or withdrawing scale from the chamber as above described for cooling steel rod rings.

Other modifications may be made to the preferred embodiment without departing from the scope of the invention. When the apparatus is used for slow cooling, heat may be supplied to the chamber 24 and it may be operated either in a forced air or in a natural air convection mode. Preferably, natural air convection will be used in chamber 24 because it provides a less abrupt change in the cooling rate between the chambers where cooling is performed by supplying heat (chambers 18, 20 and 22) and the chambers where rapid cooling by forced air convection takes place (chambers 26 and 28). Also, when desirable, chambers 26 and 28 may be adapted to cool by natural air convection. Also, the invention is not intended to be limited by the details of the blower and duct structure, the invention being intended to include any arrangement in which scale is removed from the chambers; preferably, the scale is removed pneumatically. Thus, duct control devices other than dampers may be used. Also, a reversible direction blower may be used; in this case only the damper 106 is needed and the duct 108 would lead from the duct 102 to the scale collection facility. Also, separate blowers may be used, one for forced air convection, the other for scale removal. Additionally, it may be desirable to place a damper in the duct 108 at its connection to the lower portion 90 of the chamber; this damper closes the duct 108 when the cooling mode is employed, thereby preventing heat from being diverted into duct 108.

Another possible modification relates to the technique for removing the scale accumulation from chamber 24 following the three heating chambers 18, 20 and 22. Instead of the arrangement previously disclosed (such as the dampers and the duct 108) in relation to this chamber, a much more simplified apparatus is possible. Here a single scale take-off duct connects the upper portion of the chamber (above the rollers) to the scale output duct 30. Also, in this situation the chamber has a cover thereby forming an enclosed chamber. Thus when it is desired to remove the scale from this chamber, the blower forces air into the chamber in the same manner as it does for forced air convection. Since the zone is enclosed, the scale is forced out the scale take-off duct and into the scale collection facility. In this alternation, it may be desirable to add an exhaust fan in the scale take-off duct to help promote reliable air flow.

I claim:

1. Apparatus for the disposal of scale which breaks away from hot metal while said metal is being cooled slowly under oxidizing conditions, comprising:
   a. a conveyor for transporting said metal while it is cooling,
   b. a plenum chamber under said conveyor;
   c. guide means comprising a passage for guiding scale which breaks away from said metal on said conveyor into said plenum chamber,
   d. means for removing said scale from said plenum chamber, and
   e. scale collection means associated with said plenum chamber for receiving said scale removed from said plenum chamber.

2. The apparatus of claim 1 in which said means for removing scale from said plenum chamber comprising means for causing a stream of air to flow through said plenum chamber to said scale collection means.

3. The apparatus of claim 1 together with means for retarding the cooling rate of the metal including a chamber surrounding a portion of said conveyor and means for elevating the temperature within said chamber.

4. The apparatus of claim 3 together with means for cooling the metal rapidly including means for causing a stream of cooling air to flow past said metal and then through said guide means into said plenum chamber.

5. The apparatus of claim 4 wherein the conveyor is a roller conveyor, and the means for guiding the scale are elements positioned between the rollers.

6. Apparatus for treating metal rod in direct sequence with hot rolling comprising:
   a. means for forming the rod into rings after it issues from a rolling mill;

b. means for conveying the rings in spaced, offset relation, away from said forming means;

c. a chamber surrounding said conveyor divided into an upper cooling portion above said conveyor and a lower plenum below said conveyor, said chamber being provided with passages from said upper portion to said lower plenum;

d. scale collection means associated with said plenum;

e. means for producing an air stream;

f. air flow guiding means having a first and a second position of adjustment;

g. said guiding means in said first position being adapted to guide said air stream into said plenum and then through said passages onto said rings, to cool said rings rapidly;

h. said guiding means in said second position being adapted to guide said air stream into said upper cooling portion and then through said passages into said plenum and thence to said scale collection means to convey said scale of said plenum into said scale collection means; and i. means for introducing heat into said upper chamber when said guiding means is in said first position of adjustment.

* * * * *